United States Patent [19]

McArthur

[11] 4,174,942

[45] Nov. 20, 1979

[54] FLUE CONTROL ASSEMBLY

[76] Inventor: Donald A. McArthur, 4301 Arco, St. Louis, Mo. 63110

[21] Appl. No.: 818,449

[22] Filed: Jul. 25, 1977

[51] Int. Cl.[2] ..... F23N 3/00

[52] U.S. Cl. ..... 431/20; 236/1 G

[58] Field of Search ..... 236/1 G; 431/20

[56] References Cited

U.S. PATENT DOCUMENTS

| | | | |
|---|---|---|---|
| 2,112,554 | 3/1938 | Beam | 431/20 |
| 2,165,488 | 7/1939 | Klims | 236/1 G |
| 2,326,230 | 8/1943 | Klinker | 431/20 X |
| 3,010,451 | 11/1961 | Hodgins | 231/1 G X |
| 3,090,558 | 5/1963 | Vaughn | 231/1 G |
| 4,017,024 | 4/1977 | Grostick | 231/1 G |

*Primary Examiner*—Andrew V. Kundrat

*Attorney, Agent, or Firm*—Cohn, Powell & Hind

[57] ABSTRACT

This flue control assembly is for use with a combustion chamber, such as an oven, having a thermostatically controlled burner valve circuit and includes a damper pivotally mounted in the oven flue for rotation between open and closed positions by an air actuated, movable arm assembly. The air actuated arm assembly is supplied with air from a valve controlled air pump and the valve includes a movable valve element which is resiliently connected to the movable arm and the movable valve element is moved into position to condition the supply of air from the pump by movement of the damper. An electrical switching system connected to the burner valve circuit ensures that the burner valve cannot be actuated unless the damper is in the open position in the flue.

11 Claims, 6 Drawing Figures

FLUE CONTROL ASSEMBLY

BACKGROUND OF THE INVENTION

This invention relates generally to a heat saving device for use in connection with a thermostatically controlled combustion chamber and particularly to a flue control assembly for reducing the amount of heat lost during the operation of the combustion chamber.

Most combustion chambers such as ovens, furnaces, water heaters and the like are supplied with heat intermittently by thermostatically controlled burners which are cut off when the desired temperature is achieved within the chamber and reactivated when the temperature falls below a predetermined level.

When the burners are operating in a combustion chamber it is necessary to allow the heated air to escape and flues are provided for this purpose. However, when the burners are not operating there is no need for a flue draft and, in fact, the flue draft is responsible for considerable heat loss. Most heating devices have a comparatively short burning cycle, for example the burners of a domestic furnace heater burn for considerably less than half of the time, those of a baking oven for somewhat more. Thus, if the flue is maintained in an open condition when the burners are not operating, a considerable amount of heat is drawn up the flue and wasted. Further, the draft tends to cause a problem by sucking out the pilot light in those instances in which gas or oil burners are used.

Various attempts have been made to conserve fuel and prevent the escape of heat from the combustion chamber when the burners are not operating by providing some means of closing the flue damper temporarily during these periods. Ideally, the requirements of such a flue control device are that it must open and close the damper automatically and effectively so that the damper cannot be in the closed position when the burner is operating. In addition, the operation of the device should be quiet and should be fairly rapid in its operation.

Several attempts have been made to provide an effective flue damper control but none appears to have met with general commercial acceptance. U.S. Pat. No. 2,165,488 issued to Klimis discloses a device for use with an oil furnace and depends upon a solenoid operated rack and pinion control. The damper is smaller than the flue for safety reasons so that the flue cannot be fully closed. U.S. Pat. No. 3,090,558 issued to Vaughn also discloses a flue damper control for oil furnaces the damper being operated by a reversing electric motor which is too slow for most operations.

The present flue control assembly solves the above and other problems in a manner not disclosed in the known prior art.

SUMMARY OF THE INVENTION

This flue control assembly provides automatic closing of the flue damper when the burners are not operating and includes a switching system which requires that the flue damper be open for the burners to operate.

The flue control assembly includes a damper pivotally mounted in the flue for movement between an open and a closed position; a fluid operated actuating means including an arm connected to the damper in offset relation and supplied with fluid from a valve controlled fluid pump. The valve includes a moving element responsive to movement of the damper to condition the pump to selectively supply fluid to the actuating means to move the damper. Switching means is provided connected to the burner valve circuit and conditioning the pump to supply fluid to the actuating means when the burner valve is closed by the thermostatic switch and when, in addition, the damper means is in a predetermined position.

The movable valve element is operatively connected to the actuating arm and the connection means includes spaced engagement means permitting movement of the arm without corresponding movement of the valve element.

The spaced engagement means are provided by cooperating finger and slot elements the slot having a length less than the stroke of the arm to ensure rapid action of the movable valve element.

The actuating arm is provided with resilient means whereby the arm stores energy during the initial portion of the stroke and releases such energy during the latter portion of the stroke.

The switching means includes a switch disposed between the thermostatic switch and the burner valve and actuated into a closed position when the damper means is moved into an open position, said switch including one contact fixed relative to the flue and another contact carried by a part movable with the damper and electrically engageable with the fixed contact when the damper is in the open position.

The switching means includes a pump switch actuated into a first closed position when the damper is moved into an open position and actuated into a second closed position when the damper is moved into a closed position, and the switching means includes a contact switch between the pump switch and the pump which is actuated into one position when the burner valve is closed and another position when the burner valve is open. Said switching means includes a cut-out switch to permit the damper to be moved manually to an open position from a closed position.

The flue control assembly operates quietly and rapidly and is inexpensive to manufacture and install.

DESCRIPTION OF THE PREFERRED EMBODIMENT

Figure 2:
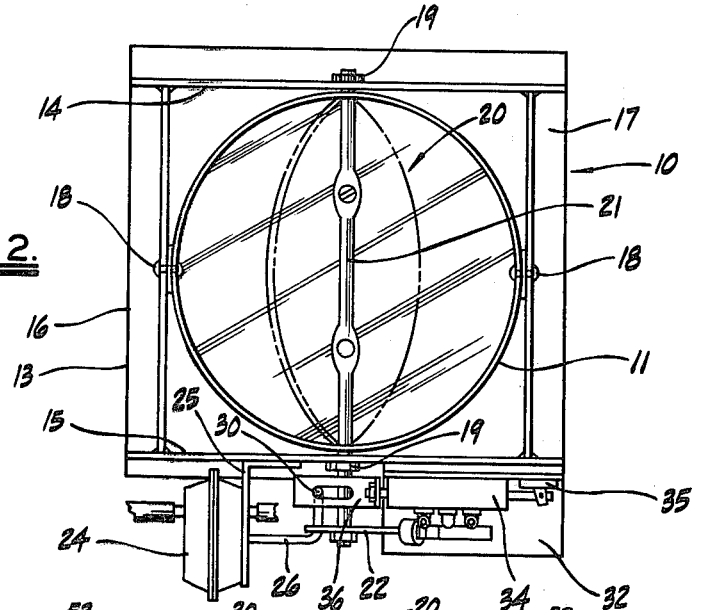
FIG. 2 is a plan view of the flue control assembly taken on line 2—2 of FIG. 1.
Figure 1:
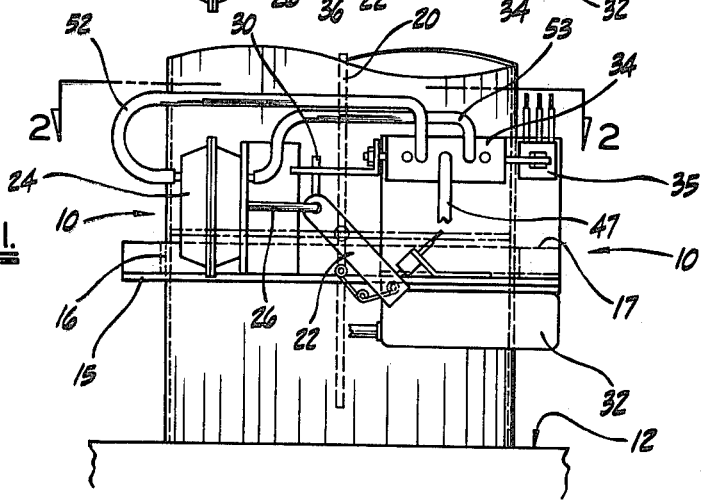
FIG. 1 is an elevational view of the flue control assembly mounted to the flue of an oven.

Referring now by characters of reference to the drawings and first to FIGS. 1 and 2, it will be understood that the flue control assembly, which is generally indicated by numeral 10, is mounted to the flue 11 of an oven 12. The control assembly 10 is mounted to the flue 11 by means of a frame 13 which consists essentially of a pair of longitudinal members 14 and 15 interconnected by transverse members 16 and 17, said members 16 and 17 being attached as by fasteners 18 to the flue 11. The damper 20, which is shown in FIG. 1 in the open position, is mounted within the flue 11 by means of a shaft 21 mounted in journal relation between longitudinal frame members 14 and 15 and held in place by means of bosses 19. The damper 20 is maintained in an open position at all times when the oven burners are operational and is closed to conserve heat within the oven 12 when the burners are shut off. The rotation of the damper 20 between the open and closed position is effectuated by control mechanism which is electrically actuated in response to a thermostatically controlled circuit, and this mechanism and electrical circuitry will now be described.

Figure 4:
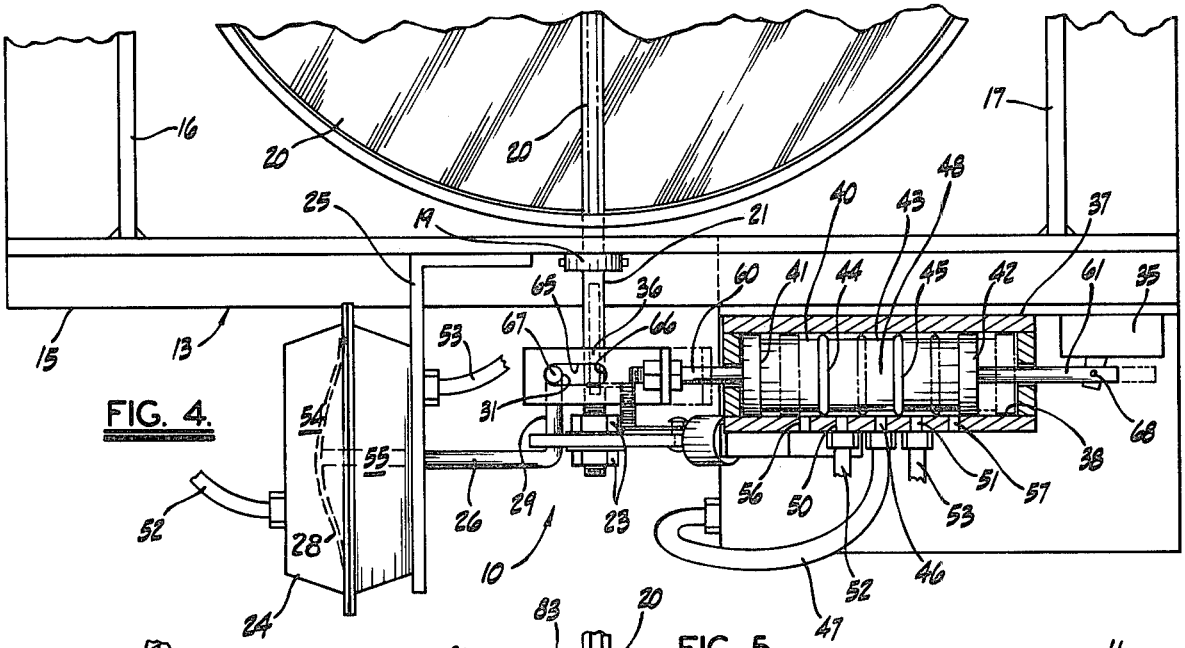
FIG. 4 is an enlarged fragmentary view of the flue control assembly taken partly in cross section to illustrate the air valve.
Figure 3:
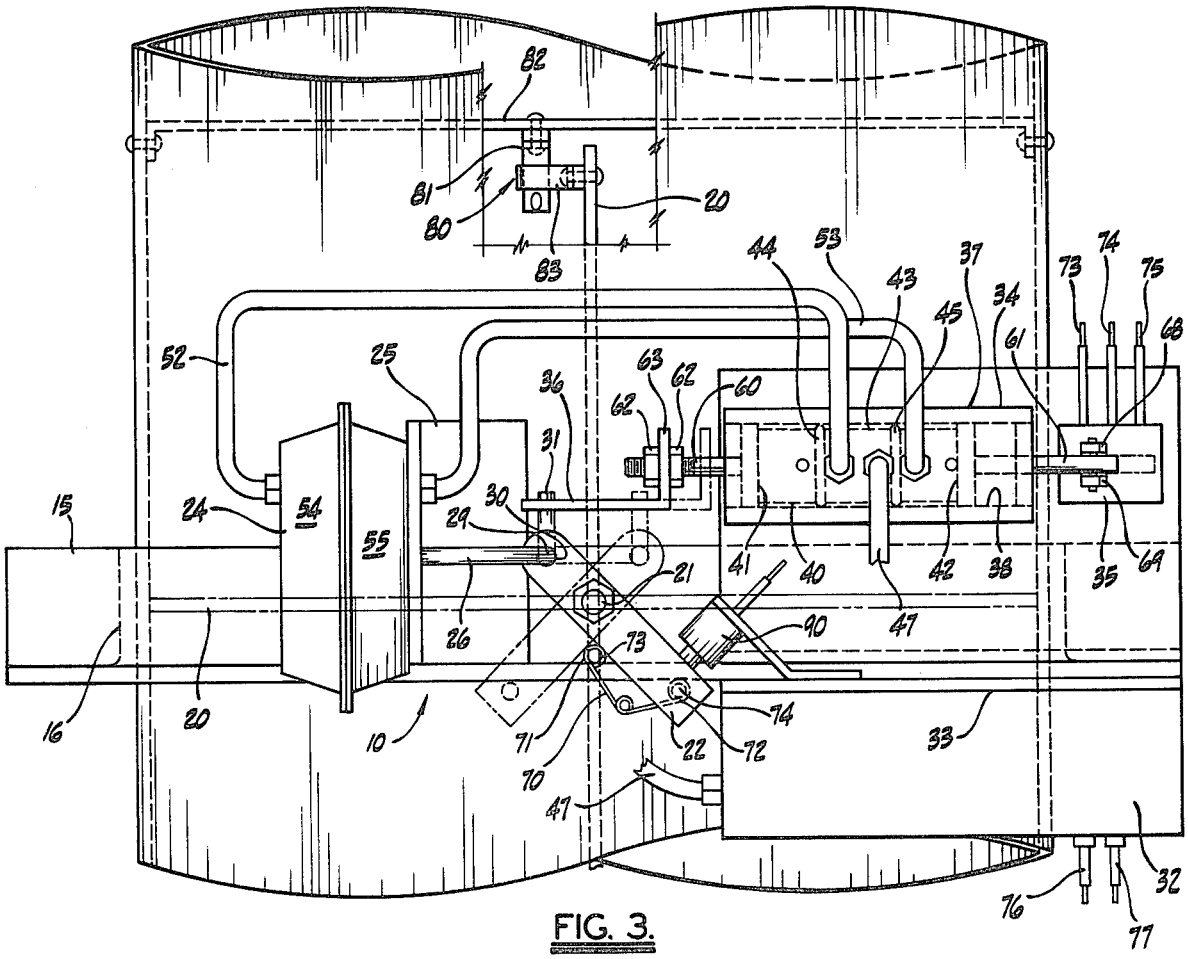
FIG. 3 is an enlarged view of the flue control assembly with a portion of the flue broken away to illustrate the damper switch.

The mechanism by which the damper is rotated is best understood by reference to FIGS. 3 and 4, in which the disposition of parts in the closed position is shown in phantom outline. Essentially, such mechanism includes a radial arm 22, which is fixedly attached to one end of the damper shaft 21 as by nuts 23. The radial arm 22 is rotated through 90 degrees by means of a diaphragm assembly indicated by numeral 24, which is mounted to a bracket 25 attached, as by welding, to frame member 15. The diaphragm assembly 24 provides a sealed housing for a flexible motor element 28 and includes a movable arm 26 attached to the motor element and having an inwardly turned end portion 29 which is pivotally received within an aperture 30 at the end of the radial arm 22. When the diaphragm arm 26 is in the retracted position, the damper 20 is in a vertical, open position, and the radial arm 22 is in the inclined position as shown in full lines in FIG. 3. When the arm 26 is in the extended position the radial arm 22 is rotated through 90 degrees, which results in the damper 20 being moved to a horizontal, closed position. Thus, the diaphragm assembly 24 and the movable means provided by the diaphragm arm 26 and the radial arm 22 pivotally connecting said arm 26 to the damper 20 in offset relation to the axis of rotation of said damper, provide a fluid operated actuating means by which the damper 20 is rotated.

In the embodiment shown, the diaphragm assembly 24 is actuated by air supplied from an air pump 32, which is mounted to the underside of frame 13 as by an outstanding bracket 33. Air from the pump 32 is routed to the diaphragm assembly 24 through an air valve generally indicated by numeral 34. The air valve 34 is mechanically connected at one end to the diaphragm arm 26 and at the other end to an air pump switch 35 which forms part of the thermostatically controlled circuitry responding to the temperature within the oven 12.

The connection between the air valve 34 and the diaphragm movable arm 26 is provided by means of an ell-shaped, slotted adaptor, which is generally indicated by numeral 36. The slotted adaptor 36 permits the arm 26 to move a finite distance before actuating the air valve 34 and the air pump switch 35. The structural arrangement of these parts will now be more specifically described.

As best shown in FIG. 4, the air valve 34 includes a body 37 having a passage 38 receiving a slidable valve element 40 mounted therewithin. The valve element 40 includes flanged end portions 41 and 42, which engage the body, and a reduced intermediate portion 43 grooved to receive a pair of O-rings 44 and 45. The body 37 includes an air inlet orifice 46, connected by an air line 47 to the air pump 32, and outlet orifices 50 and 51 connected by air lines 52 and 53 respectively, to right and left chambers 55 and 54 of the diaphragm assembly 24. The body 37 also includes vent orifices 56 and 57.

In the valve position shown in FIGS. 3 and 4, the air valve 34 is conditioned to route air through inlet orifice 46, outlet orifice 50 and, by way of line 52, to the left diaphragm chamber 54, thereby urging diaphragm arm 26 to extend outwardly to the right. The slidable valve element 40 is mounted upon a threaded shaft 48 which includes end portions 60 and 61 extending longitudinally from the end flanges 41 and 42 respectively. End portion 60 is threaded for attachment, by means of nuts 62, to the apertured upturned end portion 63 of the slotted adaptor 36. End portion 61 is apretured for attachment, as by pin 68, to the toggle 69 of the air pump switch 35.

The horizontal portion of the slotted adaptor 36 includes a slot 65, which receives the upturned end 31 of the movable arm 26 in sliding relation. Importantly, the slot 65, which is defined by opposed ends 66 and 67, has a length shorter than the stroke of the movable arm 26. The arm upturned end portion 31 moves freely within said slot before engaging the slot end 66. Engagement by the arm end portion 31 with the slot end 66 moves the adaptor 36 to the right, carrying the slidable valve element 40 with it, into the position shown in phantom outline in FIG. 3, and also moves the toggle 69 of the air pump switch 35 to the right. Movement of the air valve element 40 to the right closes the outlet orifice 50 communicating with the diaphragm chamber 54 and opens to outlet orifice 51 communicating with the diaphragm chamber 55, thereby conditioning the supply of air to said chamber 55.

Importantly, the air valve element 40 moves rapidly over the latter part of the stroke so that the orifices 50 and 51 are closed almost intantaneously. In order to provide this rapid movement, rotation of the radial arm 22 is resisted by a torsion spring 70 during the initial portion of the stroke and assisted by said spring during the final portion of the stroke. The spring 70 includes opposite ends 71 and 72. It is attached to the frame member 15 at end 71, as by a fastener 73, and is attached to the radial arm 22 at the other end 72 as by fastener 74. It will be understood that the geometrical relationship of parts is such that, as the radial arm 22 rotates through 45 degrees, the distance between these spring extremities, as defined by fasteners 73 and 74, is shortened, and that such shortening is accompanied by the torsional resistance of the spring 70. In the preferred embodiment the minimum spacing of the fasteners 73 and 74 occurs when the radial arm 22 is substantially vertical, at which point the slot end 66 is engaged by the upturned arm portion 31. Following this engagement the distance between the fasteners 73 and 74 increases and releases the stored energy in the spring 70 to assist further movement of the radial arm 22 and the diaphragm arm 26. This, during the free movement of the diaphragm arm upturned end portion 31 within the slot 65, the spring stores energy which is released after a top dead center position is reached so that said end portion 31 strikes the slot end 66 causing a relatively rapid movement of the adaptor 36 and of the valve element 40 moving said piston to the position shown in phantom outline in FIG. 3. In this position the air valve 34 is conditioned to route air through inlet orifice 46, outlet orifice 51 and, by way of air line 53 to the right diaphragm chamber 55. When air is supplied to the diaphragm chamber 55, the diaphragm arm 26 moves to the left. Initially, because of the slot 65, such movement to the left moves the radial arm 22 and stores energy in the spring 70. However, movement of the air valve element 40 and the air pump switch toggle 69 is not effectuated until the slot end 67 is engaged by the upturned end 31 of the diaphragm arm 26, at which time the movement of the valve element 40 and the toggle 69 is spring assisted and therefore relatively rapid.

Figure 5:
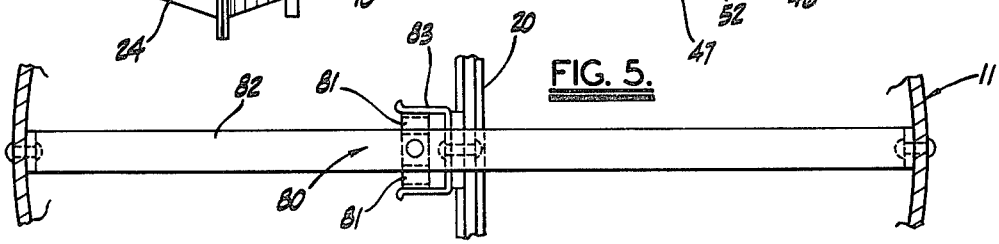
FIG. 5 is an enlarged fragmentary plan view illustrating the damper switch.

In order to ensure that the oven burners cannot be actuated unless the damper 20 is in the vertical open position, a mechanically actuated, positive damper switch 80 is provided in the oven burner circuit. This switch, which is directly actuated by the damper 20, is indicated generally by numeral 80 in FIGS. 3 and 5 and includes a pair of spaced, insulated contacts 81 mounted to a support bar 82 extending between the sidewall of the flue 11 and an insulated conductor element 83 attached to the end of the damper 20. Switch 80 cannot be closed unless the damper 20 is in the vertical, open position. An alternative form of switch indicated by numeral 90 is fixedly mounted on a bracket, attached to the frame 13, and is actuated by the radial arm 22. Switch 90 cannot be actuated unless the damper 20 is in the vertical, open position.

It is thought that the mechanical elements of this damper control assembly have become fully apparent from the foregoing description of parts. The thermostatically controlled electrical circuitry which actuates the air pump 32 will now be described with particular reference to the schematic diagram shown by FIG. 6.

Figure 6:
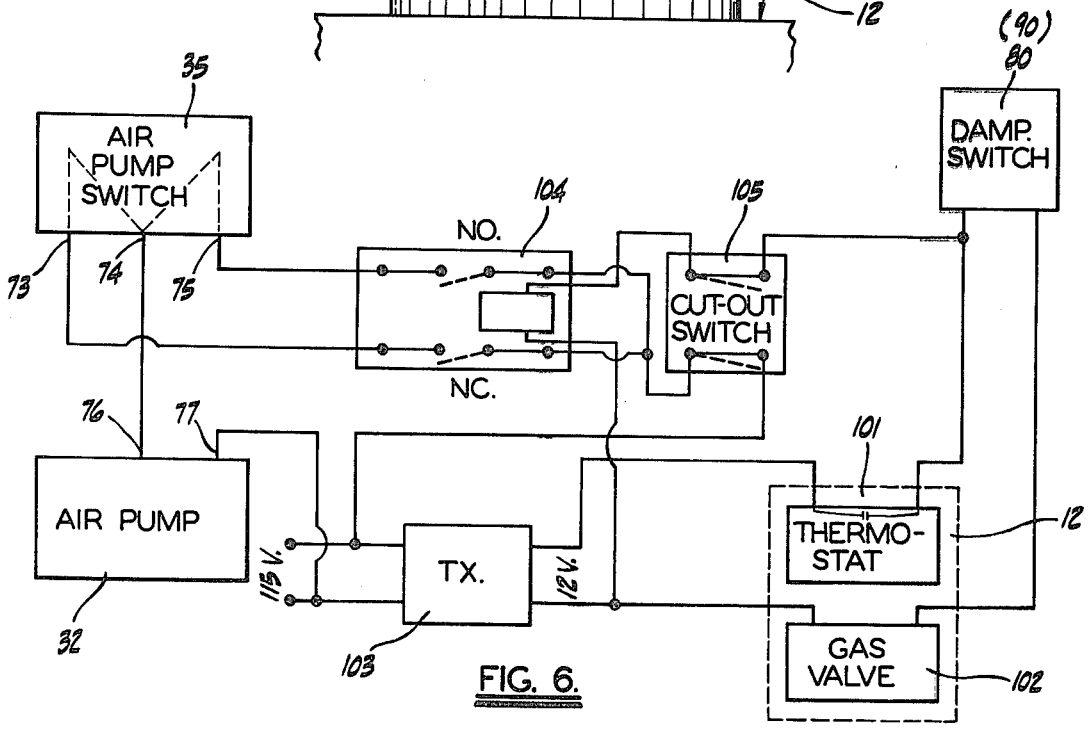
FIG. 6 is a diagrammatic view illustrating the electrical circuitry associated with the flue control assembly.

The air pump switch 35 includes terminals 73, 74 and 75 and the air pump 32 includes terminals 76 and 77 which form part of the thermostat responsive circuit shown in FIG. 6. Also forming part of this circuit is the damper switch 80, which is actuated by movement of the damper 20 as discussed above so that the oven burners cannot be operated unless the damper 20 is in the fully open, vertical position. The electrical circuitry will now be described with reference to the operation of the device as a whole, it being presumed that at the commencement of operations the damper 20 is in the open position as shown in FIG. 3.

The oven, which is indicated by numeral 12, includes a thermostat 101 and a gas burner valve 102 which is energized by power supplied from a 12 v transformer 103. The transformer 103 also supplies power to a contactor switch 104, which is actuated into an open condition when the thermostat 101 is closed. A normally closed cut-out switch 105 is used to cut off the power supply to the air pump 32 when desired.

It will be presumed that the temperature in the oven 12 has reached a predetermined high value so that the thermostat 101 opens, with the result that the solenoid operated gas valve 102 is de-energized to cut off the gas burner supply. The opening of the thermostat 101 also de-energizes the solenoid operated contactor switch 104 into the normally open (NO) and normally closed (NC) condition. Because of this and because of the switching disposition of the air pump switch 35, power is supplied to the air pump 32 via terminals 73 and 74 of said switch 35.

The disposition of the air valve 34 results in air being routed through the air valve 34 via outlet orifice 50 and air line 52 to the left chamber 54 of the diaphragm assembly 24 causing diaphragm arm 26 to move to the right. Movement of the arm 26 rotates the radial arm 22, and hence the damper 20, in a clockwise direction against the resistance of the spring 70. However, the adaptor 36 is not moved until the arm upwardly turned end 31 engages the slot end 66. This engagement does not occur until after the top dead center position of the radial arm 22 is passed at which time the movement is assisted by the torison spring 70 so that the adaptor 36 and the piston 40 are moved rapidly to the right to the position shown in phantom outline. At the end of this movement the damper 20 is in the horizontal, closed position, and air valve 34 is conditioned to supply air to right chamber 55 of the diaphragm 24 via outlet orifice 51 and air line 53. However, the air pump 32 is deactivated because the air pump switch connection between terminals 73 and 75 is broken and the disposition of the contactor switch 104 precludes the supply of current to terminal 75. The damper switch 80 is opened by the rotation of the radial arm 22.

When the temperature in the oven 12 falls to a predetermined low level value, the thermostat 101 is closed. The burner valve 102 cannot be immediately energized because the damper 20 is closed and the damper switch 80 therefore open to cut off the current supply to the burner valve 102. However, the contactor switch 104 is energized and, because of the disposition of the air pump switch 35, terminals 74 and 75 are connected, with the result that power is supplied to activate the air pump 32 and to route air through the air valve 34 via outlet orifice 51 and air line 53 to the right chamber 55 of the diaphragm assembly 24 causing the arm 26 to move to the left. This movement rotates the radial arm 22, and hence the damper 20, in a counterclockwise direction. Initially, rotation is resisted by the torsion spring 70 until top dead center is reached following which, with the assistance of the spring 70, the arm upturned end 30 engages the slot end 67 and moves the switch element 40 rapidly to the left. At the completion of this motion the damper 20 is in the vertical, open position and the damper switch 80 is closed. The air valve is conditioned to supply air to the diaphragm chamber 54, but the power supply to the air pump 32 via terminals 74 and 75 of the air pump switch 35 is cut off. The air pump 32 will not again be activated until the temperature rises sufficiently to open the thermostat 101 with the result that the damper closing cycle is recommenced. It will be understood that a double response thermostat can be substituted for the combination of the thermostat 101 and contact switch 104 if desired.

An addition to the circuit, the cut-out switch 105, provides an effective means of cutting the damper control assembly from the circuit, as a whole, so that in the event of mechanical failure of the air pump 32, with the damper 20 closed and the consequent inoperability of the gas burner valve 102, the cut-off switch 105 can be actuated and the damper 20 can be moved to an open position by manually rotating damper shaft 21 to close the damper switch 80 permit conventional operation of the thermostat 101 and gas burner valve 102 until repairs have been effectuated. The closing of the thermostat 101 and of the damper switch 80 results in the energizing of the gas burner valve 102 so that heat is supplied to the oven and will continue to be supplied until the temperature reaches the predetermined high value to open the thermostat 101.

I claim as my invention:

1. A flue control assembly for a combusiton chamber having an electrically actuated, thermostatic switch controlled burner valve circuit, the assembly comprising:

(a) flue means, (b) damper means pivotally mounted in the flue means, for movement between an open position and a closed position, (c) fluid operated actuating means including movable means operatively connected to the damper means for rotating said damper means between said open position and said closed position, (d) fluid pump means, (e) conduit means connecting the pump means to the actuating means, (f) valve means between the pump means and the actuating means said valve means selectively supplying fluid from the pump means through the conduit means to the actuating means to move the damper means from an open position to a closed position and from a closed position to an open position, and (g) switching means connected to the burner valve circuit and conditioning the pump means to supply fluid to the actuating means when the burner valve is closed by the thermostatic switch and the damper means is in a predetermined position.

2. A flue control assembly as defined in claim 1, in which:

(h) the actuating means includes a pressure chamber means mounting the movable means, (i) the valve means includes a movable valve element means, and (j) the movable valve element means is operatively connected to the movable means for movement between valve positions selectively supplying fluid to the pressure chamber means.

3. A flue control assembly for a combustion chamber having an electrically actuated, thermostatic switch controlled burner valve circuit, the asssembly comprising:

(a) flue means, (b) damper means pivotally mounted in the flue means, for movement between an open position and a closed position, (c) fluid operated actuating means including movable means operatively connected to the damper means for rotating said damper means between said open position and said closed position, (d) fluid pump means, (e) conduit means connecting the pump means to the actuating means, (f) valve means between the pump means and the actuating means said valve means selectively supplying fluid through the conduit means to the actuating means to move the damper means from an open position to a closed position and from a closed position to an open position, and, (g) switching means connected to the burner valve circuit and conditioning the pump means to supply fluid to the actuating means when the burner valve is closed by the thermostatic switch and the damper means is in a predetermined position, (h) the valve means including a movable valve element means, (i) the movable means including an arm means and offset means said offset means being carried by said damper means and being pivotally connected to said arm means in spaced relation from the pivot axis, and (j) connection means operatively connecting the movable valve element means to the movable means for movement of said valve element means between valve positions selectively supplying fluid to the actuating means, said connection means between the valve element means and the movable means including spaced engagement means on one of said means engageable by the other of said means and permitting movement of the other of said means without movement of said one means.

4. A flue control assembly as defined in claim 3, in which:

(k) the connection means includes cooperating finger means and slot means, one of said means being carried by the movable valve element means and the other of said means being carried by the movable means, said slot means having engagement means spaced apart a distance less than the movement of the movable means for movement of said valve element means during only a portion of the movement of said movable means, and (l) resilient means is connected to one of said damper means and movable arm means to store energy during part of the movement of the movable means and to release energy during continued movement of said movable means.

5. A flue control assembly as defined in claim 4, in which:

(m) the resilient means includes a torsion spring having opposite ends, one of said ends being attached to said movable means and the other of said ends being relatively fixed said spring being so disposed that said ends are moved toward each other during part of the movement of said movable means to resist movement of said movable means and store energy, and are moved away from each other during part of said movement of said movable means to release said energy and assist movement of said movable means.

6. A flue control assembly for a combustion chamber having an electrically actuated, thermostatic switch controlled burner valve circuit, the assembly comprising:

(a) flue means, (b) damper means pivotally mounted in the flue means, for movement between an open position and a closed position, (c) fluid operated actuating means including movable means operatively connected to the damper means for rotating said damper means between said open position and said closed position, (d) fluid pump means, (e) conduit means connecting the pump means to the actuating means, (f) valve means between the pump means and actuating means said valve means selectively supplying fluid through the conduit means to the actuating means to move the damper means from an open position to a closed position and from a closed position to an open position, and (g) switching means connected to the burner valve circuit and conditioning the pump means to supply fluid to the actuating means when the burner valve is closed by the thermostatic switch and the damper means is in a predetermined position, (h) said switching means including a switch disposed between the thermostatic switch and the burner valve and actuated into a closed position when the damper means is moved into an open position.

7. A flue contol assembly as defined in claim 6, in which:

(i) said switch includes one contact fixed relative to the flue means and another contact carried by the damper means and electrically engageable with said fixed contact when the damper means is in the open position.

8. A flue control assembly as defined in claim 6, in which:

(i) said switching means includes a pump switch actuated into a first closed position when the damper means is moved into an open position and into a second closed position when the damper means is moved into a closed position, and (j) said switching means includes a contactor switch between the pump switch and the pump means, said contactor switch being actuated into one position when the burner valve is closed and another position when the burner valve is open.

9. A flue control assembly as defined in claim 8, in which:

(k) said switching means includes a cut-off switch for the power means to permit the damper means to be moved manually to an open position.

10. A flue control assembly for a combustion chamber having an electrically actuated, thermostatic switch controlled burner valve circuit, the assembly comprising:

(a) flue means, (b) damper means including shaft means pivotally mounting the damper means in the flue means for movement between an open and closed position, (c) air operated actuating means including a diaphragm means having a movable arm means, and offset means carried by the shaft means said offset means being pivotally connected to the arm means in offset relation from the axis of rotation of the damper shaft means, (d) air pump means, (e) conduit means connecting the pump means to the diaphragm means, (f) valve means between the pump means and the actuating means, said valve means including a sliding valve element means selectively supplying air through the conduit means to the diaphragm means to move the movable arm means and the connected damper means from an open position to a closed position, and from a closed position to an open position, (g) connection means operatively connecting the diaphragm movable arm means to the sliding valve element means, said connection means including spaced engagement means on one of said means permitting movement of the other of said means without corresponding movement of the other of said means, (h) resilient means operatively connected to the actuating means to store energy during initial movement of the arm means and to release said energy during the final movement of the arm means to effectuate rapid action of the sliding valve element means, and (i) switching means connected to the burner valve circuit and conditioning the pump means to supply air to the diaphragm means when the burner valve is closed by the thermostatic switch and the damper means is in a predetermined position, said switching means including a switch disposed between the thermostatic switch and the burner valve and actuated into a closed position by movement of the damper means into an open position.

11. A flue control assembly for a combustion chamber having an electrically actuated, thermostatic switch controlled burner valve circuit, the assembly comprising:

(a) flue means, (b) damper means pivotally mounted in the flue means, for movement between an open position and a closed position, (c) fluid operated actuating means including movable means operatively connected to the damper means for rotating said damper means between said open position and said closed position, (d) fluid supply means, (e) conduit means connecting the fluid supply means to the actuating means, (f) valve means between the fluid supply means and the actuating means including a movable valve element operatively connected to the movable means for movement between valve positions selectively supplying fluid through the conduit means to the actuating means to move the damper means from an open position to a closed position and from a closed position to an open position, and (g) switching means connected to the burner valve circuit and conditioning the fluid supply means to supply fluid to the actuating means when the burner valve is closed by the thermostatic switch and the damper means is in a predetermined position.

* * * * *